US006926041B2

(12) United States Patent
Griffith

(10) Patent No.: US 6,926,041 B2
(45) Date of Patent: Aug. 9, 2005

(54) CARPET LOOM

(75) Inventor: John D. Griffith, Sunderland (GB)

(73) Assignee: Griffith Textile Machines Limited (GB)

( * ) Notice: Subject to any disclaimer, the term of this patent is extended or adjusted under 35 U.S.C. 154(b) by 0 days.

(21) Appl. No.: 10/276,984

(22) PCT Filed: May 23, 2001

(86) PCT No.: PCT/GB01/02299

§ 371 (c)(1),
(2), (4) Date: May 16, 2003

(87) PCT Pub. No.: WO01/90460

PCT Pub. Date: Nov. 29, 2001

(65) Prior Publication Data

US 2004/0040611 A1 Mar. 4, 2004

(51) Int. Cl.[7] ..... D03D 39/20
(52) U.S. Cl. ..... 139/46
(58) Field of Search ..... 139/37–47

(56) References Cited

U.S. PATENT DOCUMENTS 2,057,615 A * 10/1936 Hall, Jr. ..... 139/47
2,414,064 A * 1/1947 Schutz et al. ..... 139/47
2,555,159 A * 5/1951 Schutz et al. ..... 139/47
3,450,167 A 6/1969 Lygo
6,192,943 B1 * 2/2001 Griffith ..... 139/47

FOREIGN PATENT DOCUMENTS

| | | | |
|---|---|---|---|
| EP | 1 022 367 A | | 7/2000 |
| GB | 1 059 663 A | | 2/1967 |
| GB | 1059663 | * | 2/1967 |

* cited by examiner

*Primary Examiner*—Danny Worrell
(74) *Attorney, Agent, or Firm*—Nikolai & Mersereau PA; C. G. Mersereau

(57) ABSTRACT

A loom for producing a pile fabric, in particular a carpet, the loom including a reed having a plurality of reed fingers, each adjacent pair of reed fingers defining therebetween a reed dent, the reed being movable in a forwards direction to a forward most position and movable in a rearward direction to a rearward most position, a plurality of loop forming lances, each lance having a body extending through a dent in the reed, each lance having upper and lower yarn deflectors for deflecting loop forming warp yarn to one side or the other side of the lance in dependence on whether said warp yarn is travelling from above to below the lance or vice versa, each lance further including a guide formation engageable with both opposed reed fingers in said reed for determining the warp wise position of side upper and lower warp yarn deflectors relative to said opposed reed fingers when the reed is at its rearmost position, said guide formations being located outside the dents of said reed when the reed is at its forwardmost position to permit loop forming yarn to pass between each lance (2) and its associated dent (15) in the reed (20).

9 Claims, 6 Drawing Sheets

CARPET LOOM

The present invention relates to a loom for weaving pile fabric, in particular carpet.

The present invention also relates to a loop pile conversion assembly for attachment to a loom, in particular, a Wilton loom to enable the loom to produce cut or looped piles.

According to one aspect of the present invention there is provided a loom for producing a pile fabric, in particular a carpet, the loom including a reed having a plurality of reed fingers, each adjacent pair of reed fingers defining therebetween a reed dent, the reed being movable in a forwards direction to a forward most position and movable in a rearward direction to a rearward most position, a plurality of loop forming lances, each lance having a body extending through a dent in the reed, each lance having upper and lower yarn deflectors for deflecting loop forming warp yarn to one side or the other side of the lance in dependence on whether said warp yarn is travelling from above to below the lance or vice versa, each lance further including a guide formation engageable with both opposed reed fingers in said reed for determining the warp wise position of said upper and lower warp yarn deflectors relative to said opposed reed fingers when the reed is at its rearmost position, said guide formations being located outside the dents of said reed when the reed and at its forwardmost position to permit loop forming yarn to pass between each lance and its associated dent in the reed.

In one embodiment of the invention said reed comprises the beat up reed of the loom.

According to another aspect of the present invention there is provided a loom for producing a pile fabric, in particular a carpet, the loom including a beat up reed having a plurality of reed fingers, each adjacent pair of reed fingers defining therebetween a reed dent, the beat up reed being movable in a forwards direction to a beat-up position and movable in a rearward direction to a weft-insertion position, a further reed located on the rearward side of the beat up reed, the further reed having a plurality of reed fingers, each adjacent pair of reed fingers defining therebetween a reed dent, a plurality of loop forming lances, each lance having a body extending through a dent in the beat up reed and a corresponding dent in the further reed, each lance having upper and lower yarn deflectors for deflecting loop forming warp yarn to one side or the other side of the lance in dependence on whether said warp yarn is travelling from above to below the lance or vice versa, each lance further including a guide formation engageable with opposed reed fingers in said further reed for determining the warp wise position of said upper and lower warp yarn deflectors relative to said opposed reed fingers, the further reed being movable between a rearmost position whereat said guide formations of the lances are located within the dents of said further reed and a forwardmost position whereat said guide formations are located outside the dents of said further reed to permit loop forming yarn to pass between each lance and its associated dent in the further reed.

According to another aspect of the present invention there is provided an assembly for attachment to a loom, in particular a Wilton loom, for enabling loop or cut pile carpet to be produced, the assembly including, a plurality of loop forming lances, each lance being capable of extending through a dent in the beat up reed of the loom, each lance including upper and lower yarn deflectors for deflecting loop forming warp yarn to one side or other of the lance in dependence on whether the loop forming warp yarn is being raised or lowered past the lance, and each lance further including a guide formation engageable with opposed reed fingers of said reed for determining the warp wise position of said upper and lower yarn deflectors relative to said opposed reed fingers.

The assembly may also include a further reed for location on the rear ward side of the beat up reed.

According to a further aspect of the invention, there is provided a pile loop forming lance for a loom, in particular a Wilton loom, including a reed having a plurality of reed fingers with adjacent fingers being spaced apart to define a dent, the lance including upper and lower yarn deflectors for deflecting loop forming warp yarn to one side or other of the lance in dependence on whether the loop forming warp yarn is being raised or lowered past the lance, and each lance further including a guide formation engageable with opposed reed fingers of said reed for determining the warp wise position of said upper and lower yam deflectors relative to said opposed reed fingers.

Various aspects of the present invention are hereinafter described with reference to the accompanying drawings, in which.

Figure 1:
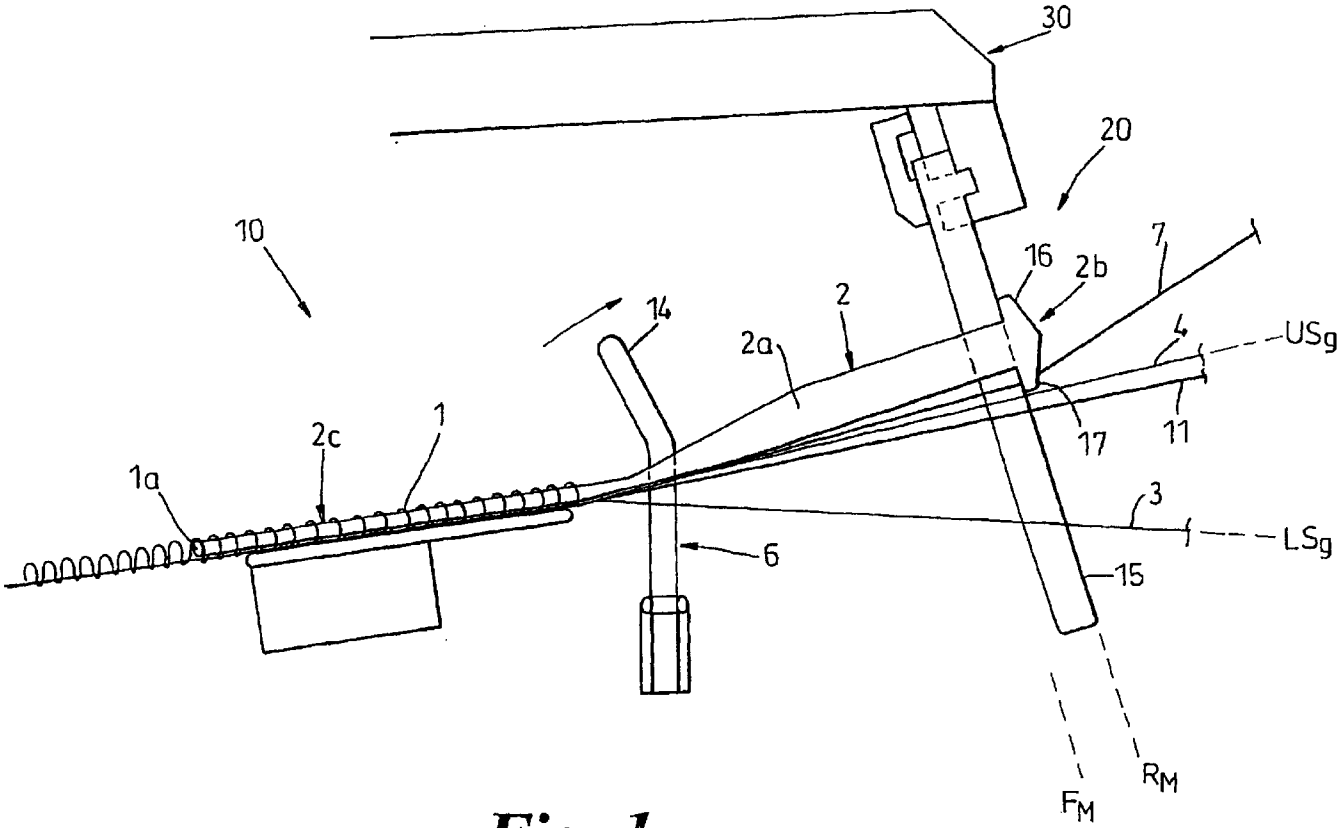
FIGS. 1 to 4 are each a side view of a loom according to an embodiment of the present invention shown at different stages during the weaving cycle.

Referring initially to FIG. 1 there is shown a loom 10 including a beat up reed 6 including a plurality of side by side reed fingers 14.

Each adjacent pair of fingers 14 define therebetween a reed dent.

Passing through each reed dent is a loop forming lance 2 and at least one, preferably several, loop forming warp yarns 7, 11. When several loop forming yarns 7, 11 are provided, they preferably have different physical characteristics, eg. colour to enable desired patterns to be woven.

Figure 4:
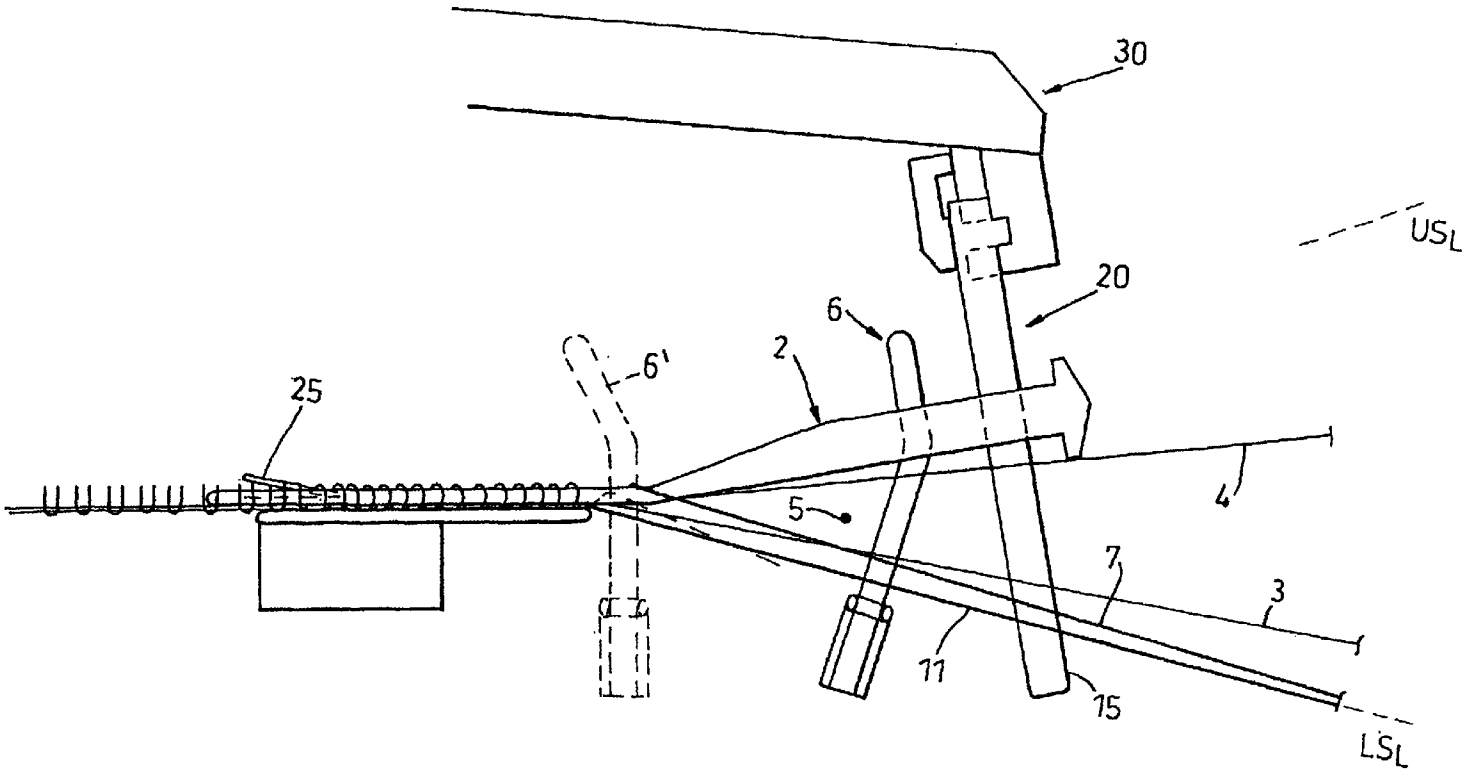

Warp displacement means (not shown) such as cams, jacquard or dobby act to move the ground warp yarns 3, 4 between upper and lower shed positions $US_g$ and $LS_g$ respectively (FIG. 1) and also move the loop forming warp yarn 7, 11 between upper and lower shed positions $US_L$ and $LS_L$ respectively (FIG. 4).

Each lance 2 has a main body portion 2*a* having a head portion 2*b* at one end and a tail portion 2*c* at is opposite end.

The tail portion 2*c* is relatively narrow and of a constant height for defining the loop height of the formed loops 1.

The formed loops 1 slide forwardly along the tail portion 2*c* during the weaving process before sliding off the forward end 1*a*. Accordingly, a plurality of loops 1 are retained on the tail portion 2*c* at any one time and these retained loops 1 serve to hold the lance 2 in position in the weft direction.

A second reed 20 made up of spaced apart reed fingers 15, is located on the rearward side of the beat up reed 6.

Each lance 2 extends through a reed dent defined by a pair of adjacent fingers 15 such that the head portion 2*b* of the lance 2 is located on the rearward side of the reed 20.

In addition, the same yarns which pass through a reed dent in reed 6 also pass through a corresponding reed dent in reed 20.

The reed 20 is supported on a drive mechanism 30 which, in synchronism with the weaving cycle, moves the reed 20 between a forwardmost position $F_M$ and a rearwardmost position $R_M$.

The head portion 2*b* of each lance 2 has an upper yarn deflector 16 and a lower yarn deflector 17.

Figure 5:
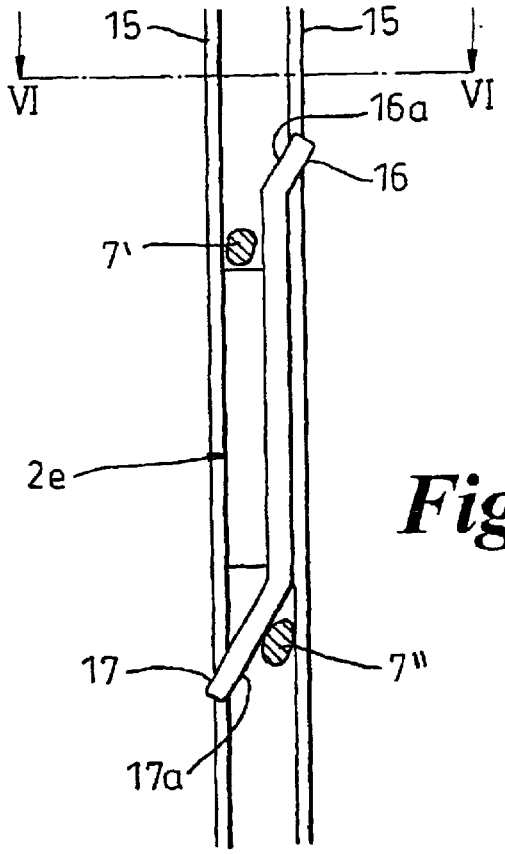
FIG. 5 is a part end view of the loom shown in FIG. 1.

The upper deflector 16 serves to co-operate with a loop forming yarn 7, 11 to move the yarn to one side of the lance 2 on its downward travel from its upper shed position $US_L$ to its lower shed position $LS_L$. This is shown in FIG. 5 by the yarn 7'. The lower yarn deflector 17 serves to co-operate with a loop forming yarn 7, 11 to move the yarn to the opposite side of the lance 2 on its upward travel from its lower shed position $LS_L$ to its upper shed position $US_L$. This is shown in FIG. 5 by the yarn 7".

In order to positively position the upper and lower yarn deflectors 16, 17 in the weft wise direction, each lance 2 on the rearward side of the head portion 2*b* is provided with a guide formation 2*e* which, when located in a reed dent, engages the adjacent reed fingers 15 and so restricts warp wise movement of the lance head portion 2*b*.

The guide formation 2*e* enters into a reed dent when the reed 20 is located in the region of its rearwardmost position $R_M$ and exits from the dent when the reed 20 is located in the region of its forwardmost position $F_M$.

Figure 6:
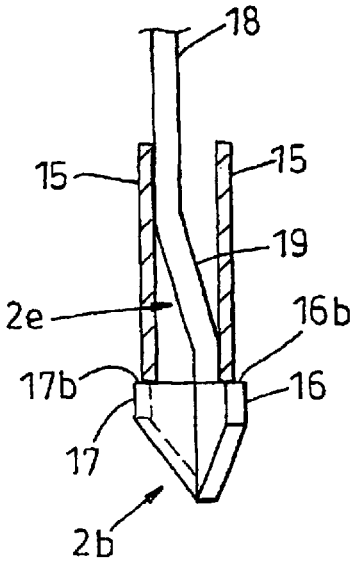
FIG. 6 is a cross-sectional view of the loom taken along line VI—VI in FIG. 5.
Figure 7:
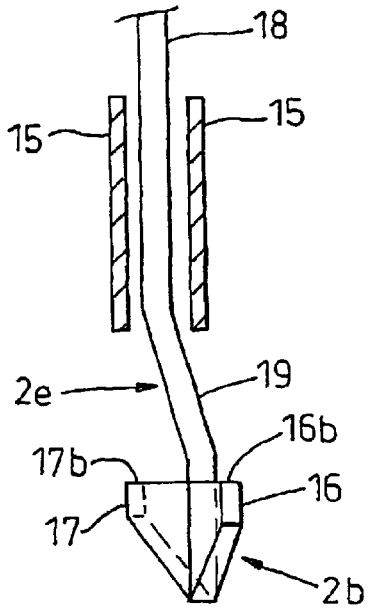
FIG. 7 is a similar view to FIG. 6 but showing the loom in a different operational position.

Preferably each lance 2 is formed from a strip-like material, such as metal, having a thickness which is sufficiently less than the width of the dents in reeds 6 and 20 to enable warp yarns 3, 4, 7 or 11 to freely pass thereby. The guide formation 2*e* is preferably formed by a cranked portion 19 which serves to space the outer faces of the lance 2 further apart for engagement with a pair of adjacent reed fingers 15 (see FIGS. 5 and 6).

Preferably each yarn deflector 16, 17 is formed by outwardly bending a part of the head portion 2*b* to define a yarn deflection face 16*a*, 17*a*, respectively and also define a shoulder 16*b*, 17*b* for engaging the rearward edges of adjacent reed fingers 15.

Accordingly, during weaving, when the reed 20 moves toward its rearmost position $R_M$, fingers 15 engage shoulders 16*b* and 17*b* and move the lance 2 rearwardly.

In operation, the warp yarns 3 and 4 are moved between their upper and lower shed positions $US_g$ and $LS_g$ (both of which are located below the lances 2) in order to create a shed for insertion of weft yarn 5.

The loop forming yarns 7, 11 are located at an intermediate shed position which is preferably located near to the upper shed position $US_g$ of the warp yarns 3, 4, preferably above the path of weft insertion but below the lances 2.

A selected loop forming yarn 7 is raised to its upper shed position $US_L$. During this movement, the reed 20 is located at its rearmost position $R_M$ and so the guide formation 2*e* of each lance 2 is located in a dent of reed 20.

The raised yarn 7 is thereby guided by the lower yam deflector 17 to one side of the lance head portion 2*b* and is trapped between the yarn deflector 17 and the opposed reed finger 15 (FIG. 1, shown as yarn 7" in FIG. 5).

Figure 2:
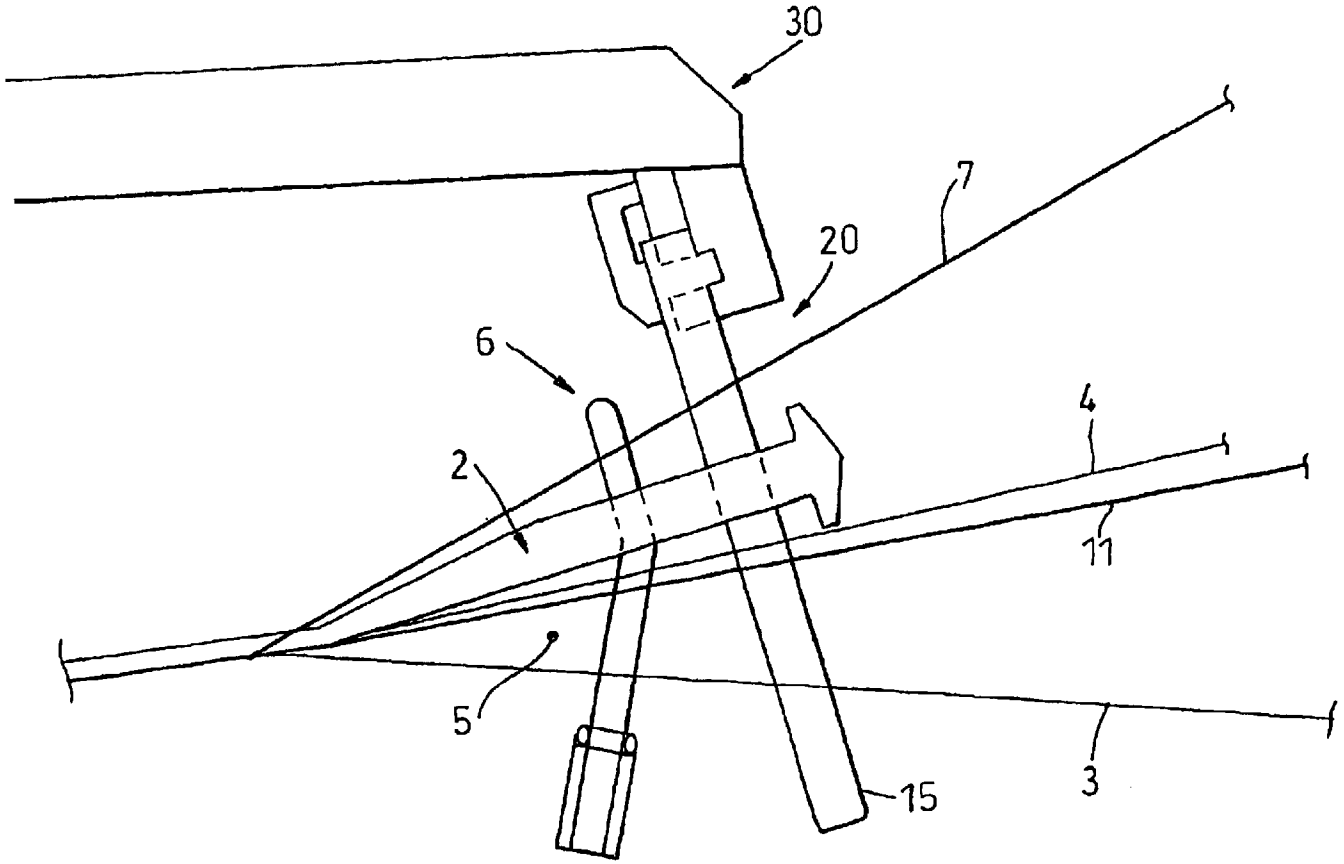

The reed 20 then moves toward its forwardmost position $F_M$ to move the guide formation 2*e* out of the reed dents of reed 20 and so release yarn 7 and enable it to move above the lance 2 (FIG. 2).

During this time, the beat up reed 6 moves rearwardly to enable a weft yarn 5 to be inserted.

The reed 20 then moves rearwardly as the beat up reed 6 moves forwardly to beat up the inserted weft yarn 5. Rearward movement of the reed 20 causes the guide formations 2*e* to enter the dents of reed 20 and also cause the reed fingers 15 to engage shoulders 16*b*, 17*b*. The lances 2 therefore are held against forward movement which may otherwise be caused by advancement of the carpet as it is being woven.

Figure 3:
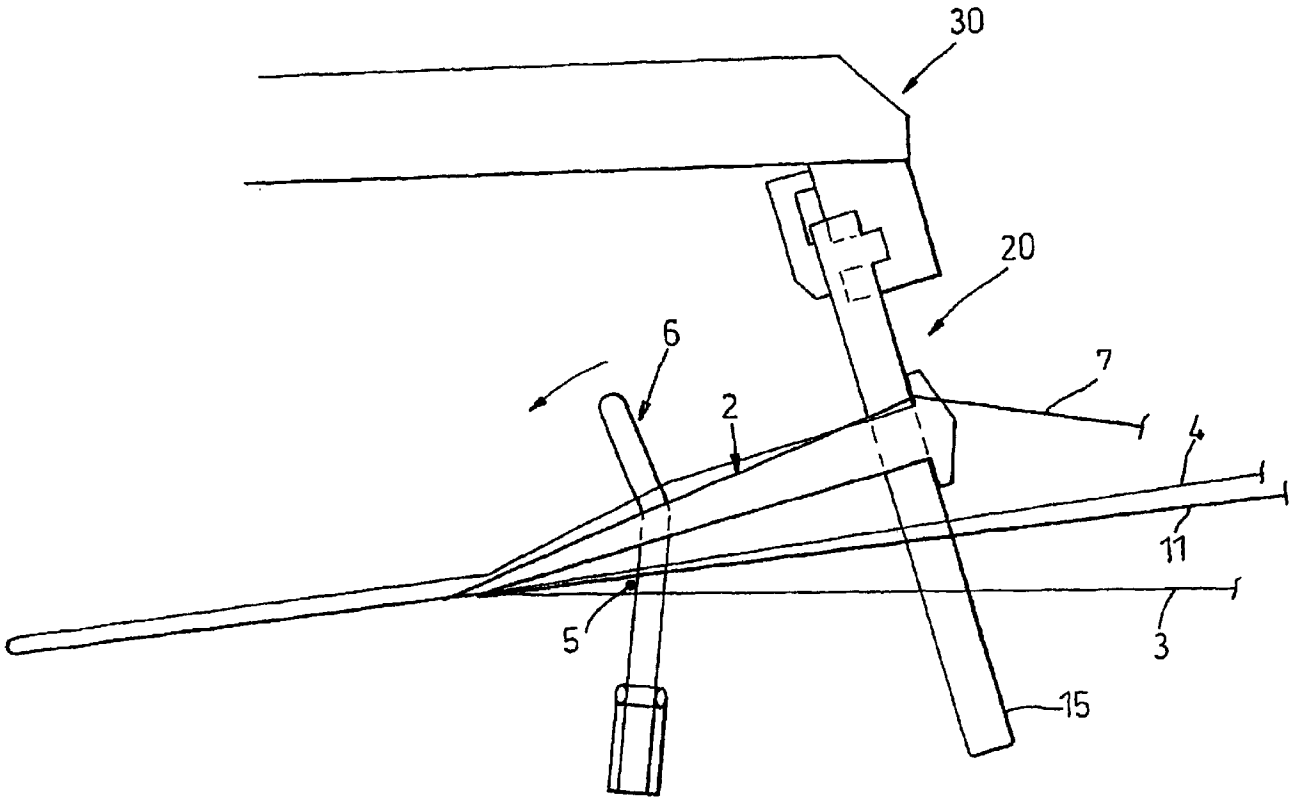

The loop forming yarn 7 is now moved to its lower shed position $LS_L$ and is thereby guided by the upper yarn deflector 16 to the opposite side of the lance head portion 2*b*. The yarn 7 is now trapped between the deflector 16 and the opposed reed finger 15 (FIG. 3 and shown in yarn 7' in FIG. 5).

The reed 20 is now moved toward its forwardmost position $F_M$ out of the dents of reed 20 and so release yarn 7 and enable it to move below the lance 2.

At the same time, the reed 6 is moved to its rearmost position to enable another weft yarn to be inserted.

In the above process, by raising and lowering a selected loop forming yarn 7 above and below a lance, loops 1 are formed which slide off the lances to form a loop pile.

If desired, as illustrated in FIG. 4, cut pile may be produced by, for example, mounting a cutting blade 25 on each tail portion 2*c* so that as the loops 1 slide along the tail portion 2*c* they are severed.

Figure 8:
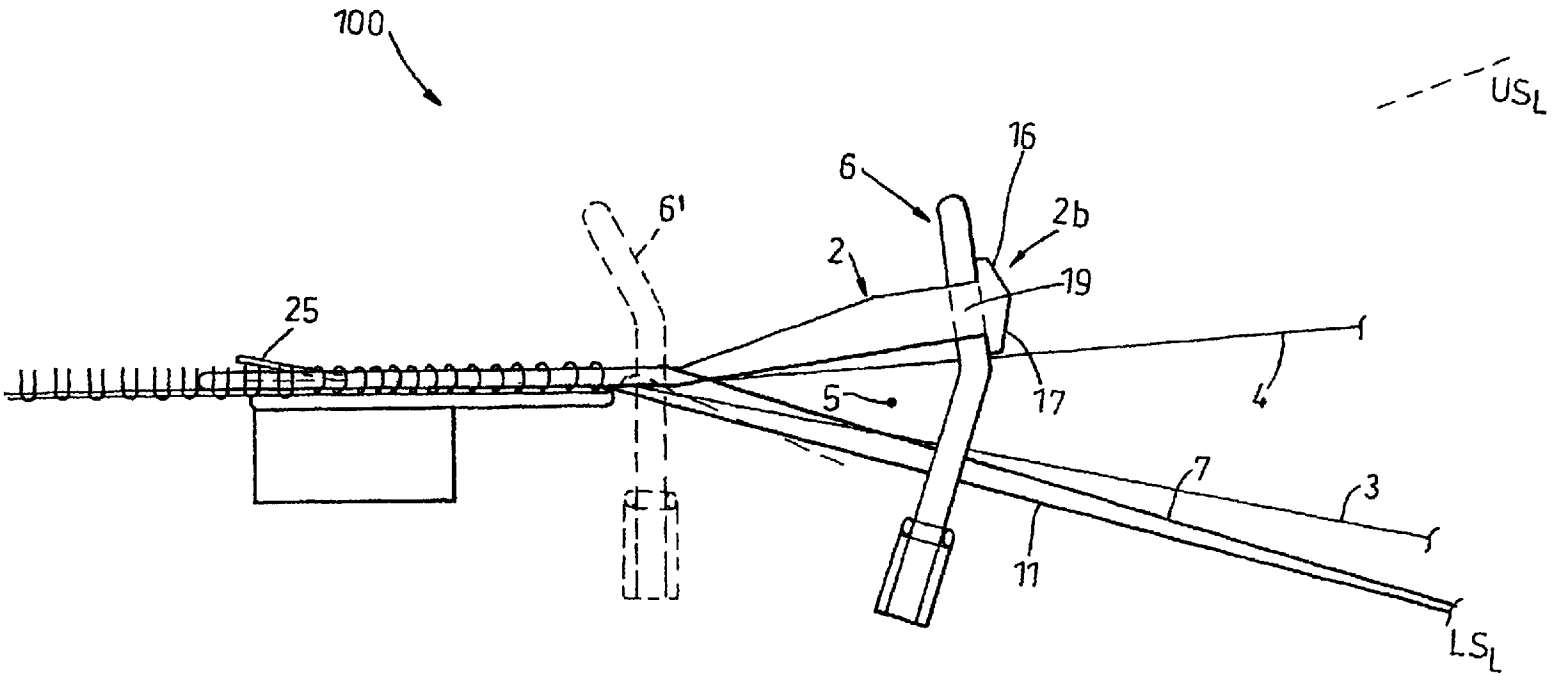
FIG. 8 is a side view of the loom according to a further embodiment of the present invention.

A further embodiment 100 as illustrated in FIG. 8. For embodiment 100, parts similar to those in the embodiment of FIG. 1 are shown with the same reference numerals.

In embodiment 100, is the same as the embodiment of FIG. 1 with the exception that, in embodiment 100 reed 20 is omitted and the beat up reed 6 is arranged to function both as the beat up reed and also perform the function of reed 20.

Accordingly, as illustrated in FIG. 8, when the reed 6 is at its rearmost position (for weft insertion); this position corresponds to the rearmost position $R_m$ of the second reed 20. Accordingly at this position, the reed 6 abuts against the head portion 2*b* of each lance.

What is claimed is:

1. A loom for producing a pile fabric, the loom including:

(a) a reed having a plurality of reed fingers, each adjacent pair of reed fingers defining therebetween a reed dent, the reed being movable in a forward direction to a forward most position and movable in a rearward direction to a rearward most position;

(b) a plurality of loop forming lances, each lance having a body extending through a dent in the reed, each lance having upper and lower yarn deflectors for deflecting loop forming warp yarn to one side or the other side of the lance in dependence on whether said warp yarn is traveling from above to below the lance or vice versa, each lance further including a guide formation engageable with both opposed reed fingers in said reed for determining the warp wise position of said upper and lower warp yarn deflectors relative to said opposed reed fingers when the reed is at its rearmost position; and (c) wherein said guide formations are located outside the dents of said reed when the reed is at its forward most position to permit loop forming yarn to pass between each lance and its associated dent in the reed.

2. A loom according to claim 1 wherein each lance has a main body portion having a head position at one end and a tail portion at its opposite end, the head portion being located on the rearward side of said reed.

3. A loom according to claim 2 wherein each lance is formed from strip-like material having a thickness less than the width of the dents in said reed.

4. A loom according to claim 3 wherein said guide formation for each lance is defined by a cranked portion which serves to space outer faces of the lance further apart for engagement with a pair of adjacent reed fingers.

5. A loom according to either claim 3 or 4 wherein the head portion of each lance is provided with an upper yarn deflector and a lower yarn deflector, each deflector being formed by outwardly bending a part of said head portion to define a yarn deflection face and also a shoulder for engaging rearward edges of adjacent reed fingers.

6. A loom according to any one of claim 1–4 wherein said reed is the beat-up reed of the loom.

7. A loom according to claim 5 wherein said reed is the beat-up reed of the loom.

8. A loom according to any one of claims 1–4 wherein said reed is an additional reed located on the rearward side of the beat-up reed of the loom.

9. A loom according to claim 5 wherein said reed is an additional reed located on the rearward side of the beat-up reed of the loom.

* * * * *